United States Patent [19]

Miller et al.

[11] Patent Number: 4,766,800

[45] Date of Patent: Aug. 30, 1988

[54] GUN AND MAGAZINE SYSTEM

[76] Inventors: Michael K. Miller; Warren D. Stockton, both of 405 E. 19th St., Bakersfield, Calif. 93305

[21] Appl. No.: 802,152

[22] Filed: Nov. 25, 1985

Related U.S. Application Data

[63] Continuation-in-part of Ser. No. 736,071, May 20, 1985, Pat. No. 4,676,137.

[51] Int. Cl.[4] ..... F41C 25/10; F41C 23/00; F41G 1/02

[52] U.S. Cl. ..... 89/33.02; 89/33.1; 42/49.01; 42/72; 42/73; 42/100; 33/254

[58] Field of Search ..... 33/254; 42/17, 49.01, 42/71.01, 72, 73, 87, 100; 89/1.42, 33.01, 33.02, 33.1, 33.17

[56] References Cited

U.S. PATENT DOCUMENTS

| | | | |
|---|---|---|---|
| 2,263,918 | 11/1941 | Burton | 42/17 |
| 2,293,128 | 8/1942 | Fortin | 42/72 |
| 2,321,720 | 6/1943 | Whittaker | 89/33.02 X |
| 2,367,572 | 1/1945 | Gazda | 89/33.02 X |
| 3,088,378 | 5/1963 | Boudreau | 89/33.02 X |
| 3,427,923 | 2/1969 | Meyer et al. | 89/33.02 |
| 3,662,469 | 5/1972 | Charron | 42/100 X |
| 3,729,853 | 5/1973 | Critcher | 42/65 |
| 3,747,249 | 7/1973 | Ouellette | 42/50 |
| 4,327,626 | 5/1982 | McQueen | 42/73 X |
| 4,332,097 | 6/1982 | Taylor, Jr. | 89/33.02 X |
| 4,539,889 | 9/1985 | Glock | 89/147 |

FOREIGN PATENT DOCUMENTS

| | | | |
|---|---|---|---|
| 73415 | 1/1894 | Fed. Rep. of Germany | 42/73 |
| 1065756 | 9/1959 | Fed. Rep. of Germany | 42/72 |

*Primary Examiner*—John F. Terapane
*Assistant Examiner*—John S. Maples
*Attorney, Agent, or Firm*—Roylance, Abrams, Berdo & Goodman

[57] ABSTRACT

An improved gun/magazine system which is top loading and wherein the magazine is of generally cylindrical configuration. A spiral drive of the cartridges through the magazine into the top loading receiver of the gun is provided. The magazine includes a spring/winder having a silent clutch which permits tensioning of the drive spring at any time and even immediately before use, and which has a release means in order to permit relaxing of the spring in the event the unprecedented large capacity of cartridges is not entirely expended from the magazine. The cylindrical shaped magazine is mounted above, parallel to, and closely adjacent to the axis of the gun.

53 Claims, 8 Drawing Sheets

FIG.6
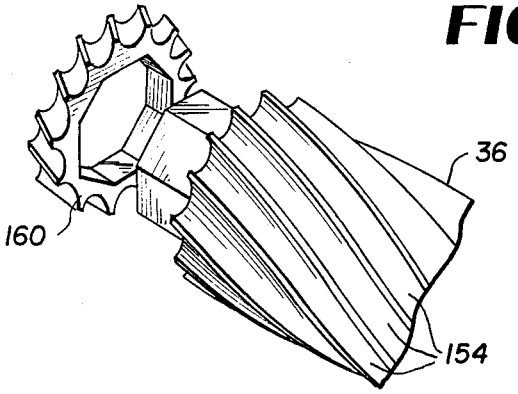
FIG.7
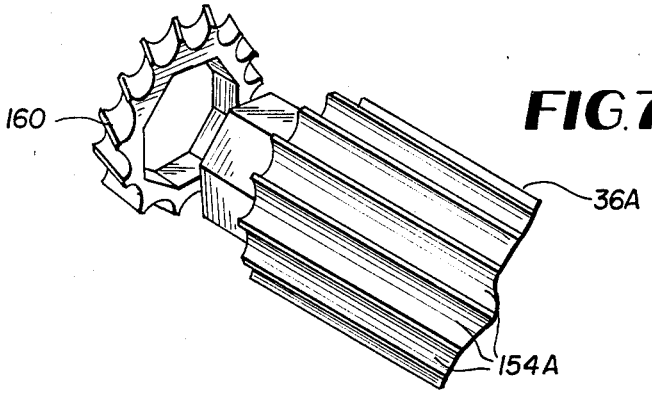
FIG.8
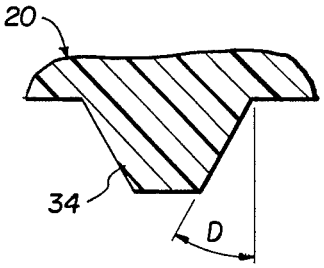
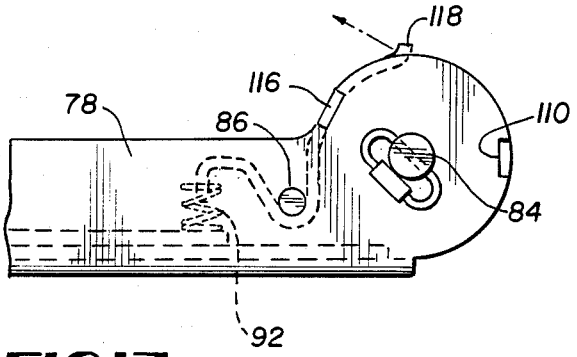
FIG.17
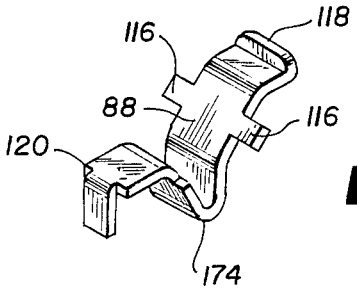
FIG.18

FIG.19
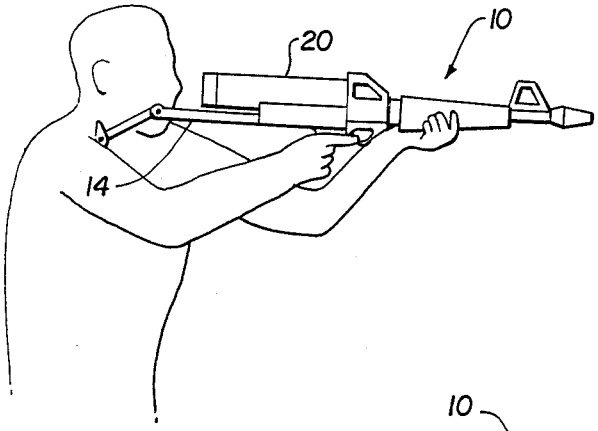
FIG.20
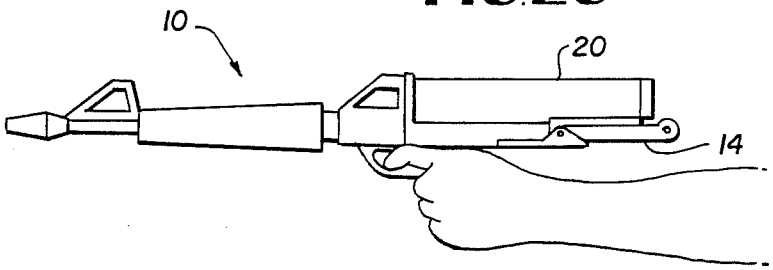
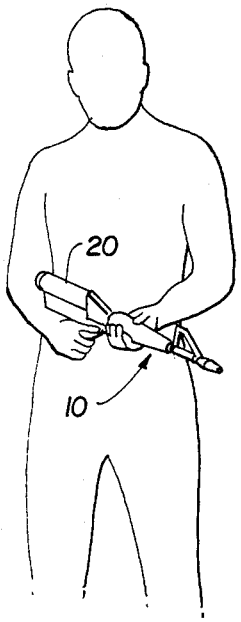
FIG.21
FIG.9
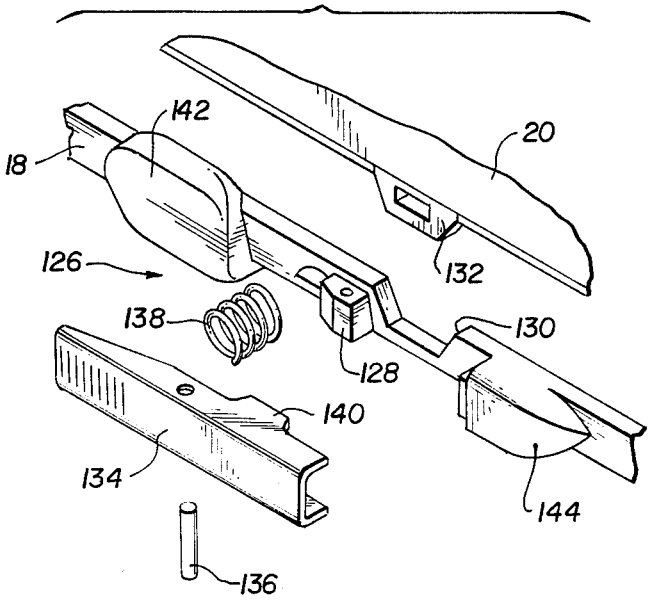

FIG. 22
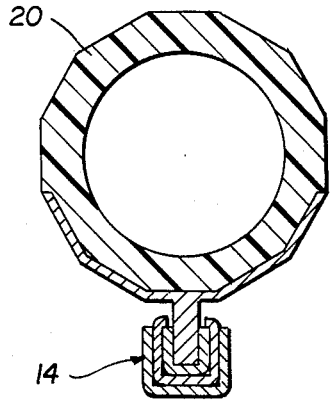
FIG. 23
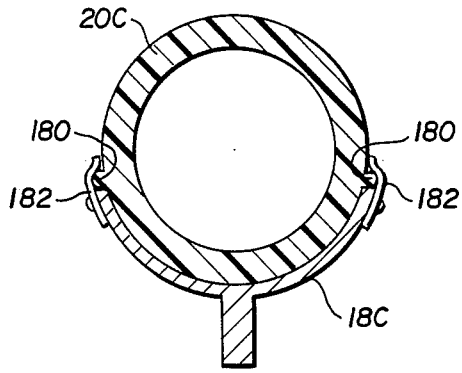
FIG. 24
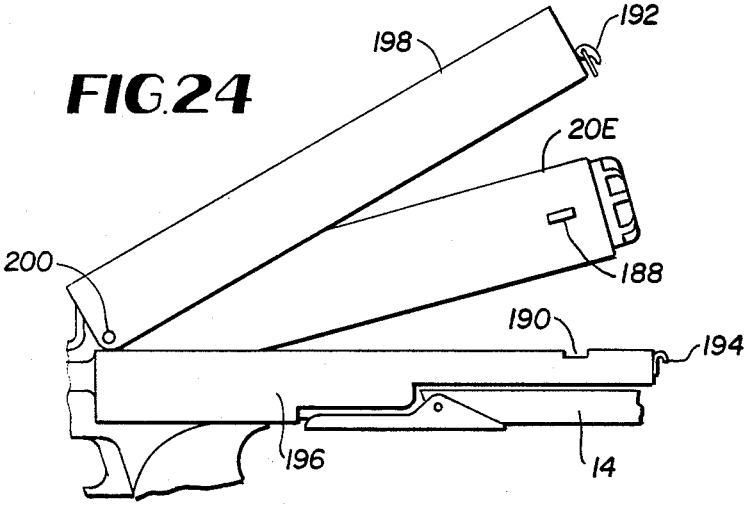
FIG. 25
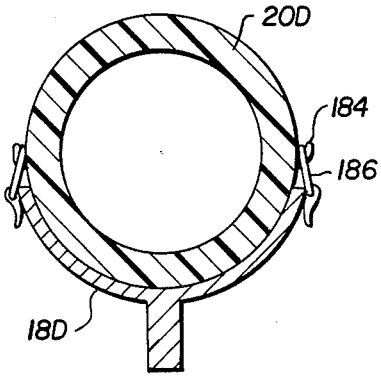
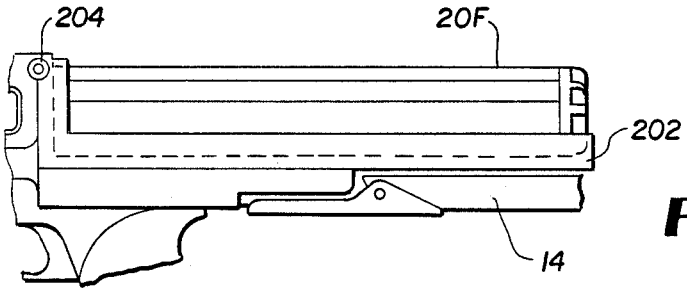
FIG. 26

GUN AND MAGAZINE SYSTEM

CROSS-REFERENCE TO RELATED APPLICATION

This application is a continuation-in-part of our copending U.S. application Ser. No. 736,071, filed May 20, 1985, now U.S. Pat. No. 4,676,137, the entire disclosure of which is hereby incorporated herein by reference.

FIELD OF THE INVENTION

This invention relates to firearms, and more particularly, it relates to a system comprising a magazine and a firearm adapted to accept the magazine. The magazine is characterized by having a relatively large capacity for ammunition. More specifically, the invention relates to such a system as applied to automatic and semi-automatic firing guns.

BACKGROUND OF THE INVENTION

Guns and magazines for such guns are a highly developed art. However, the prior art has numerous problems which are overcome by the present invention.

More specifically, gun systems having magazines which have a relatively large ammunition capacity usually tend to extend away from the gun at a right angle to the axis of the gun. Examples of such magazines include drum-type ammunition magazines for light machine guns and "banana"-type clips for automatic and semi-automatic guns. Magazines of this sort have a substantial problem in that they create a substantial weight located well away from the axis of the gun, which creates a moment when the gun is in use, which destroys the aim, makes the gun harder to use, creates more user fatigue, and the like. The present invention overcomes all of these problems as set forth below.

A chronic problem in the prior art of gun/magazine systems that have relatively large ammunition capacity has been that of spring fatigue in the magazine. The more cartridges or bullets in the magazine, the stronger the spring to drive all the bullets out of the magazine. This is caused, where the magazines are pre-loaded, spring fatigue if the magazine is stored for a relatively long period of time loaded with bullets. The undesirable result of such spring fatigue can be that the last bullets in the magazine will not be fed into the gun, or else will be fed insufficiently vigorously to thus cause a jam.

In military applications this problem has been solved in a way that creates its own problems. Basically, in military applications, double logistics are used. That is, the bullets are shipped in separate boxes and the magazines in separate boxes. This requires the soldiers in the field to load the magazines with bullets in combat.

The present invention solves this problem in the prior art as well as providing an improved magazine which permits shipment of the magazine loaded with bullets but with the spring relaxed.

The prior art has also had problems in the area of folding butt stocks. The present invention provides an improvement in this area in that the butt stock folds flat against the gun in line with the magazine, and thus creates no additional problems or unbalancing forces when the gun is used with one hand.

SUMMARY AND ADVANTAGES OF THE INVENTION

The present invention gun/magazine system provides a firearm which is top leading and a magazine which is of generally cylindrical configuration. The magazine includes a spiral drive of a high volume of cartridges into the top loading gun. The cylindrical magazine is positioned above and parallel to the axis of the gun.

The cylindrical magazine is able to accept a relatively large number of cartridges because of the spiral drive which comprises an inner fluted drive member in the magazine. A helical torsion spring is provided inside the fluted drive member to drive the cartridges via the drive member through the magazine.

The magazine includes a centrifugal ramp type of clutch and manual spring winder arrangement which permits the magazine to be easily loaded with cartridges. Thereafter, the fully loaded magazine, but with the spring relaxed, can be stored indefinitely. This is a substantial advantage for the invention over the prior art in that the spring fatigue problem is totally avoided. That is, the spring is not wound up or tensioned until immediately before the cartridge magazine is to be used.

Yet another advantage of the invention is means to cause the clutch to be silent. This is an important advantage of the invention in that the magazine spring can be wound up and made ready for use in a manner which is not detectable during hunting or in combat.

Yet a further advantage of the invention has to do with a release built in to the magazine to relieve the spring force. This permits safe storage of a magazine with only some of the cartridges therein. Again, after preparation for use or after partial use, the magazine, either fully or partially loaded, can be stored indefinitely with absolutely no danger whatsoever of the drive spring suffering any fatigue.

The fluted drive member provides an important advantage in that the flutes can be curved at any particular angle to accommodate different sizes of cartridges or to accommodate cartridges with or without rims.

Further, the flutes in the drive member provide an important advantage of insulating the cartridges from the very substantial full strength of the drive spring. Absent the flutes in the drive member, with the very large number of cartridges with which the invention magazine can be used, it would be possible for the cartridges to jam in their travel through the magazine.

Yet another advantage of the invention magazine is that it lends itself to fabrication virtually entirely of plastic. This provides substantial advantages over the prior art wherein the magazines are fabricated mostly of metal, these advantages residing in the area of reduced costs of manufacture and lighter weight. Lighter weight is particularly important for military use.

Yet a further advantage of the invention has to do with the ability of the magazine to be repeatedly reloaded.

The invention gun/magazine system includes means to permit quick changing of magazines on and off the gun. This mounting system can take many embodiments. Further, means can be also be provided to urge the magazine upwardly into the hand of the user by means of a spring force when a trigger or the like is released. This speeds up changing of magazines even further.

Another advantage of the invention gun/magazine system is that it makes no conceptual or basic changes in the actual firing and shell ejection means of standard weapons. This permits the invention system to be accommodated to use with all sorts of standard weapons with little modification thereof.

Yet a further advantage has to do with improvements to the front end sight. These improvements permit the front end sight to cooperate with the increased height of the gun/magazine system at the vicinity where the magazine is mounted on the gun, while at the same time permitting the advantage of elevation adjustment and sighting in of the gun.

Another advantage of the invention is the provision of such a system applicable for use with all sorts of firearms and with all calibers of weapons, including automatic and semi-automatic weapons, including handguns, rifles, carbines, shotguns, and machine guns.

A further advantage of the invention is to provide a system of the character described which has a minimal frontal area and is thus of reduced overall size and weight for use in confined spaces and with rapid motion of the user.

An object of the invention is to provide a system of the character described which is well balanced for accurate firing, which will automatically line up with the user's forearm for use in the so-called "point-shoot" mode, and which is highly accurate in use.

The invention provides a gun/magazine system which is highly adapted to the rigors of use both as a hunting weapon and as a combat weapon, which is applicable to use with all sorts and sizes of guns, which is economical to manufacture, which avoids the spring fatigue problem of present high ammunition capacity magazines, which can accept an unprecedented large number of cartridges, which is adaptable to use with all sorts of gun operating systems, and yet which is highly efficient and practical in its manufacture and use.

The invention system provides improved handling, as compared to an automatic weapon using a conventional "banana" clip, because the entire mass of the invention magazine with the mass of the large number of cartridges therein, is all very close to the line of recoil which is axial with respect to the gun. Because of this, the moment arm is only an inch or two long. Thus, the invention magazine produces a much smaller active moment tending to push the gun off its aiming axis, than does the moment produced by a banana clip which has a moment arm on the order of six or eight inches long, i.e., from the middle of the banana clip to the axis of the gun. This is a critical advantage of the invention in improved handling.

A further advantage of the invention system is that it is relatively small while having a relatively large capacity of cartridges. This makes it much easier to store and to be kept on the person of guards and the like who do not want it obvious that they are carrying a gun. This is the case with undercover policemen, secret service guards, and the like. This advantage flows primarily from the fact that the invention magazine can store a large number of cartridges in a relatively small space.

Yet another advantage of the invention is the provision of an improved folding butt stock which folds away compactly when not in use on the gun at the underside of the magazine thereon and which is unobtrusive and does not interfere with use. When extended, the butt stock is highly efficient while at the same time of light weight and durable.

With the butt stock folded, the invention gun/magazine system lends itself to one-hand operation because of its excellent balance. More specifically, as to one-hand operation, with the butt stock folded and with the piston grip at about the midpoint of the weapon, the total length of the magazine and the weapon extending to the rear of the piston grip is less than the length of the forearm of an average person. This permits twisting and pivoting and pointing from the shoulder, which is good gun handling practice. That is, the most desirable shooting posture involves the creation of a straight line of the weapon through the forearm and ending at the bent elbow of the user. The relatively compact size of the invention permits this desirable posture. Pointing of the gun can then occur from motion at the shoulder rather than motion of the body.

The dramatically increased cartridge capacity of the invention gun/magazine system is of critical importance, especially in a military environment. Battles and perhaps even wars could be won if the soldiers of one side had three times the ammunition capacity in a clip as compared to the enemy soldiers.

Thus the invention provides a compact gun/magazine system, having no projections transverse to the gun's axis, and having a heretofore unheard of large capacity of cartridges (up to one hundred cartridges for .22 caliber), while providing a gun/magazine system having improved weight distribution and correspondingly improved handling characteristics.

BRIEF DESCRIPTION OF THE FIGURES OF THE DRAWING

The invention will be understood more clearly with reference to the accompanying drawing, which drawing also forms a part of this disclosure, and wherein:

FIG. 6 is a partial perspective exploded view of the drive end of the fluted drive member of the magazine in accordance with a first embodiment thereof;

FIG. 7 is a view similar to FIG. 6 showing a second embodiment thereof;

FIG. 8 is an exploded partial view of a detail looking in the direction of the arrows 8—8 of FIG. 4;

FIG. 9 is an exploded perspective view of the preferred form of the magazine latch assembly;

FIGS. 17 and 18 are detailed views of parts of the folding butt stock;

FIGS. 19, 20 and 21 are "action" views showing different manners of use of the invention gun/magazine system;

FIG. 22 is a cross-sectional view taken on line 22—22 of FIG. 10;

FIG. 23 is a view similar to FIG. 22 showing a variation of means to lock the magazine onto the gun;

FIG. 24 is a side elevational view of the magazine locking embodiment; and

FIGS. 25 and 26 are views similar to FIGS. 23 and 24, respectively, showing another embodiment of means to removably lock the magazine onto the gun.

DETAILED DESCRIPTION OF THE PREFERRED EMBODIMENTS

Figure 1:
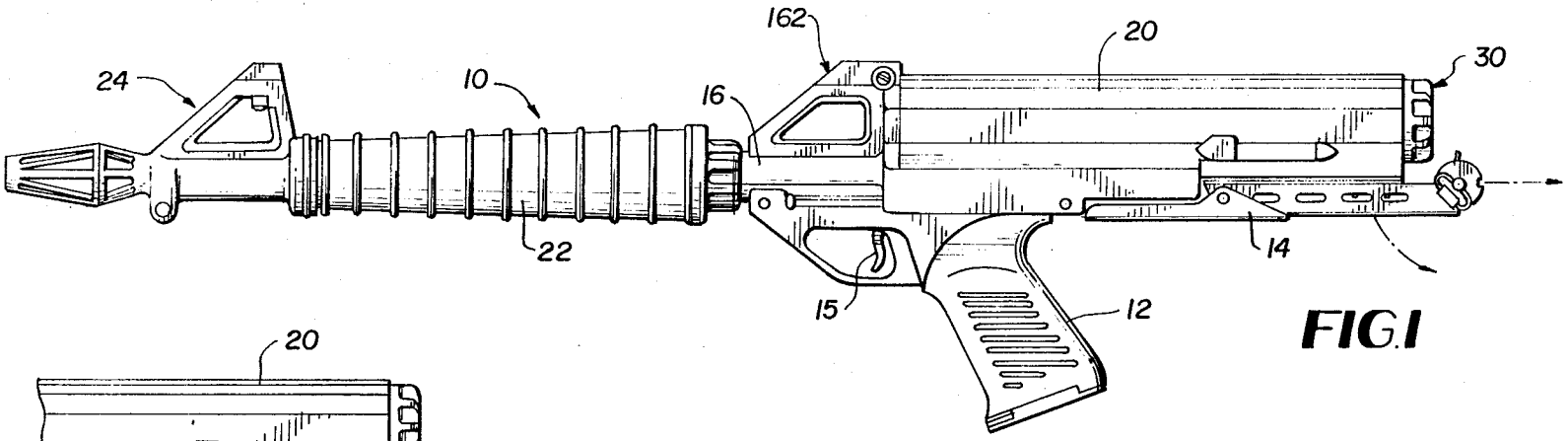
FIG. 1 is a side elevational view of a rifle embodying the gun/magazine system of the invention with its butt stock folded.

Referring now in detail to the drawings, reference numeral 10 indicates a gun/magazine embodying the invention. Gun 10, chosen by way of example only, may be thought of as an attack rifle, a light machine gun, or a semi-automatic rifle. The weapon of FIG. 10 may be used in any of the common postures, see FIGS. 19, 20 and 21.

Gun/magazine system 10 comprises a piston grip 12 including a trigger 15 mounted generally midway along the length of the weapon 10. To the rear of the pistol grip 12 weapon 10 includes a folding butt stock assembly 14 mounted to the underside of the rear portion of the body of the gun 18 (see FIG. 3). A high-capacity ammunition magazine 20 in accordance with the invention is removably mounted on the rear body portion 18.

This arrangement of the location of the magazine and the center mounted pistol grip improves the front/rear balance and overall handling characteristics of the invention gun/magazine system.

The forward part of the weapon 10 shown in FIG. 1 comprises a barrel 16, the intermediate length of which is surrounded by a shroud or front hand grip 22. The front end of the barrel terminates at a combined flash suppressor and front sight assembly 24.

Figure 4:
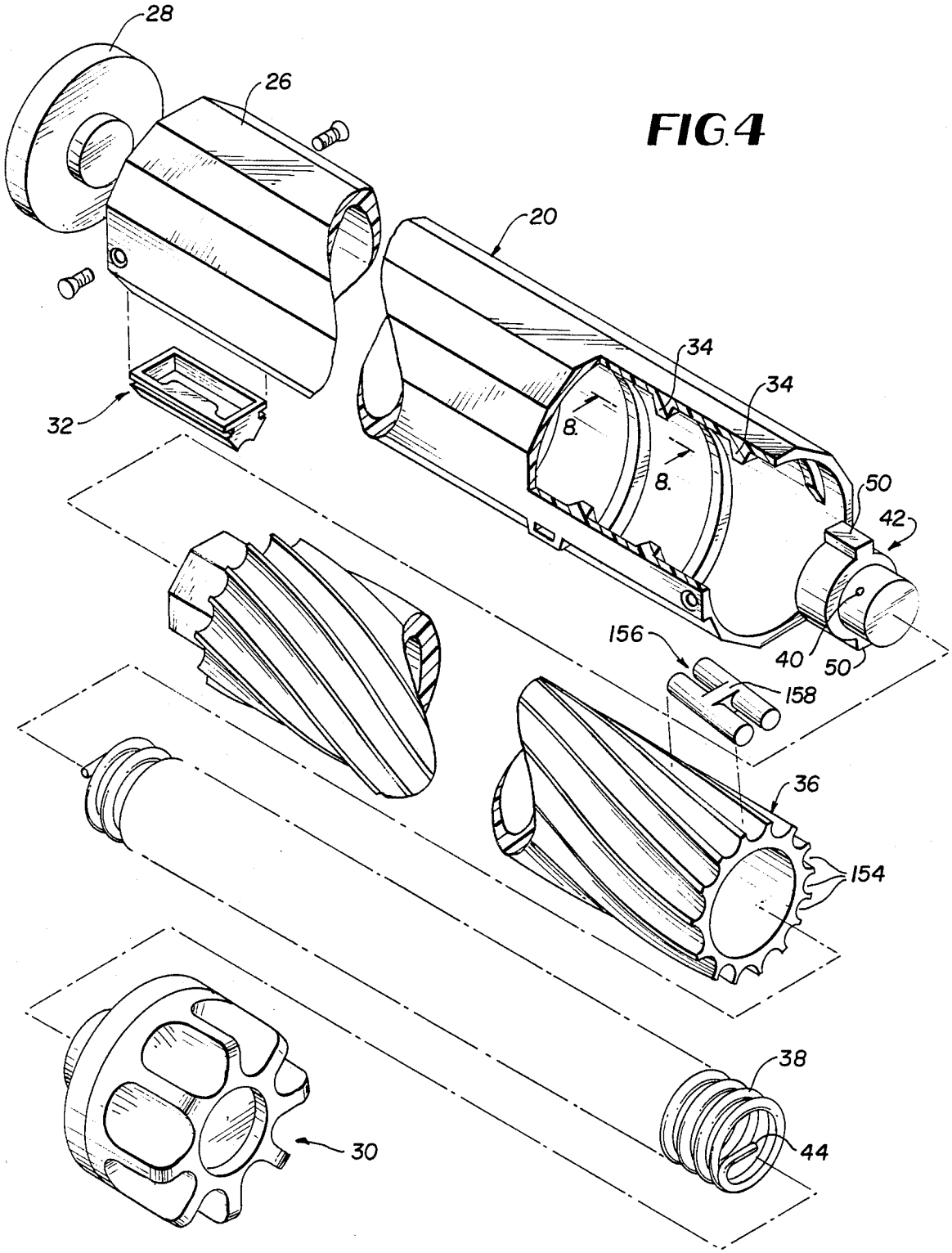
FIG. 4 is an exploded view of the magazine with some parts broken away in cross-section.
Figure 10:
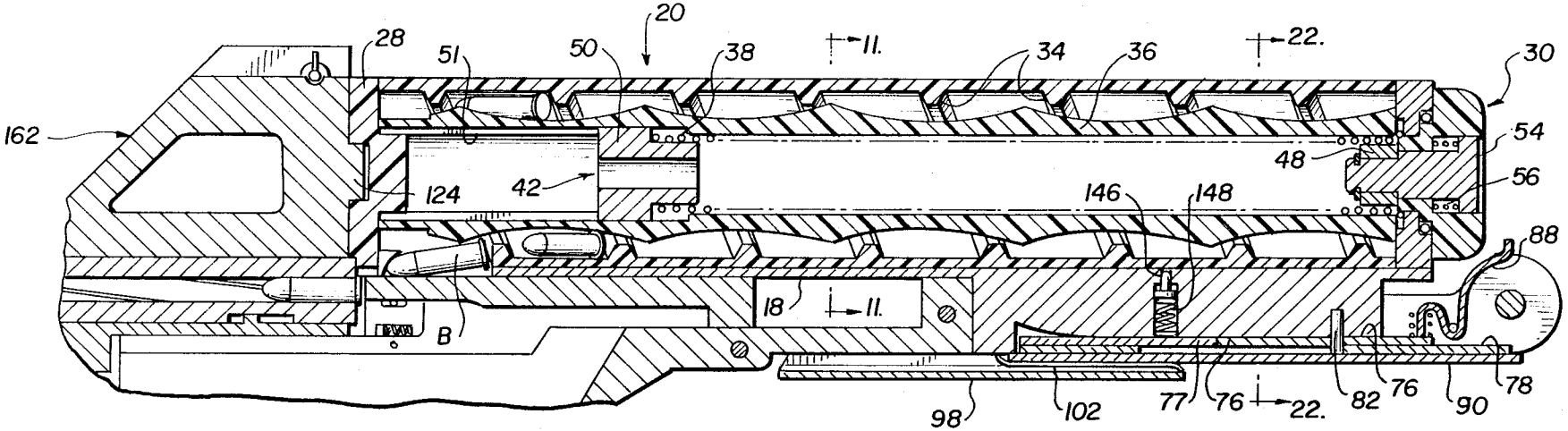
FIG. 10 is a vertical longitudinal cross-sectional view showing the magazine mounted on the gun and the action of the cartridges being fed through the magazine and into the gun receiver.

FIG. 4 shows an exploded view of a first embodiment of the magazine 20 in accordance with the invention. FIG. 10 shows a cross-sectional view of this same magazine 20 mounted on the gun. The reader may wish to refer to both FIGS. 4 and 10 as this description of the magazine progresses in order to facilitate understanding.

Figure 5:
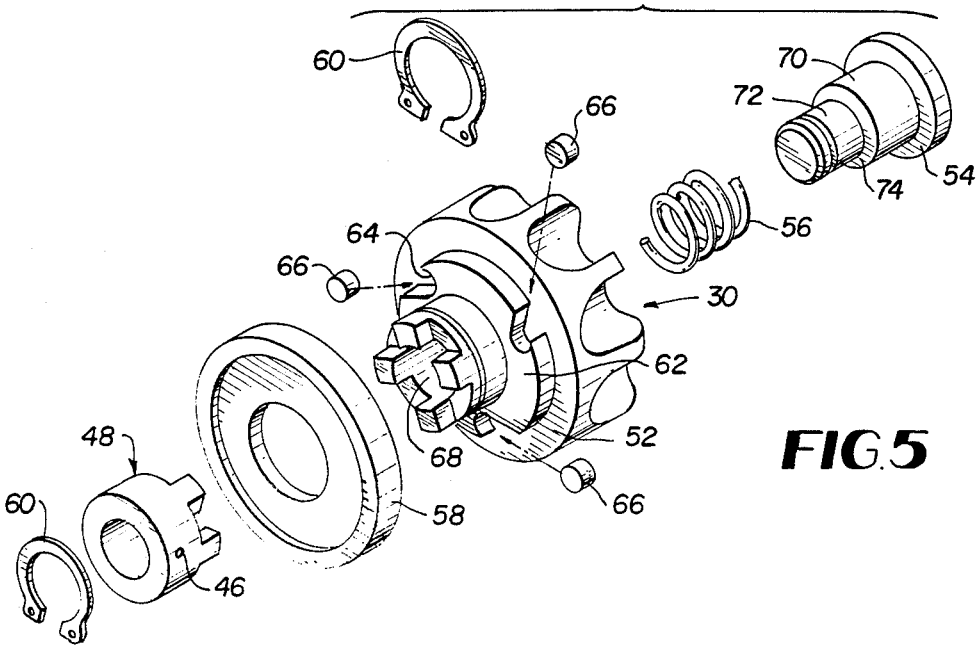
FIG. 5 is a view similar to FIG. 4 showing the magazine clutch assembly exploded apart.

Magazine 20 comprises a main housing or shell 26, a front end cap 28, and a clutch assembly 30 at the rear end of the magazine. Clutch assembly 30 is shown in FIG. 5 and is described in detail below.

A cartridge or bullet feed lip 32 is provided at the front end of the magazine for cooperation with the receiver of the gun in the conventional manner. FIG. 10 shows a bullet B feeding down out of the magazine into the receiver of the gun.

In this regard, the manner of handling the bullets or cartridges in the gun after they leave the magazine 20, including firing and ejection of the spent shells, is substantially conventional. Minor constructional changes to accommodate the invention to existing weapons may be needed, but the basic principles of operation of such existing guns will remain unchanged.

The inside of the magazine housing 26 is formed with a helical screw thread 34 winding around the inside of the housing and extending from end to end thereof (see FIG. 10).

Positioned inside the housing 26 is a fluted drive member 36 having a length substantially equal to housing 26. Positioned inside the drive member 36 is a drive spring 38. Torsion spring 38 has its ends formed into radial fingers 44, one of which is received in an opening 40 of a front end sliding spring anchor 42. The fingers 44 are similar to each other, one at each end of the spring. The opposite anchor finger 44 is received in a hole 46 in the front end dog member of clutch 48, see FIG. 5.

When spring 38 is relaxed, it has a length less than that of the magazine housing 26. However, the spring 38 is of substantial length to drive the large number of cartridges, and thus means must be provided to accommodate its increase in length when it is wound up by the clutch/winder assembly 30.

Referring to FIGS. 4 and 10, this is accomplished by the front end spring anchor 42, which is formed with a pair of sliding dogs 50 which are received in mating slots 51 formed for a predetermined length in from the front end of the drive member 36.

Thus, FIG. 10 shows the spring 38 unwound, with the sliding anchor 42 over to the right. When the spring is fully wound, the anchor member 42 will be to the left.

Figure 3:
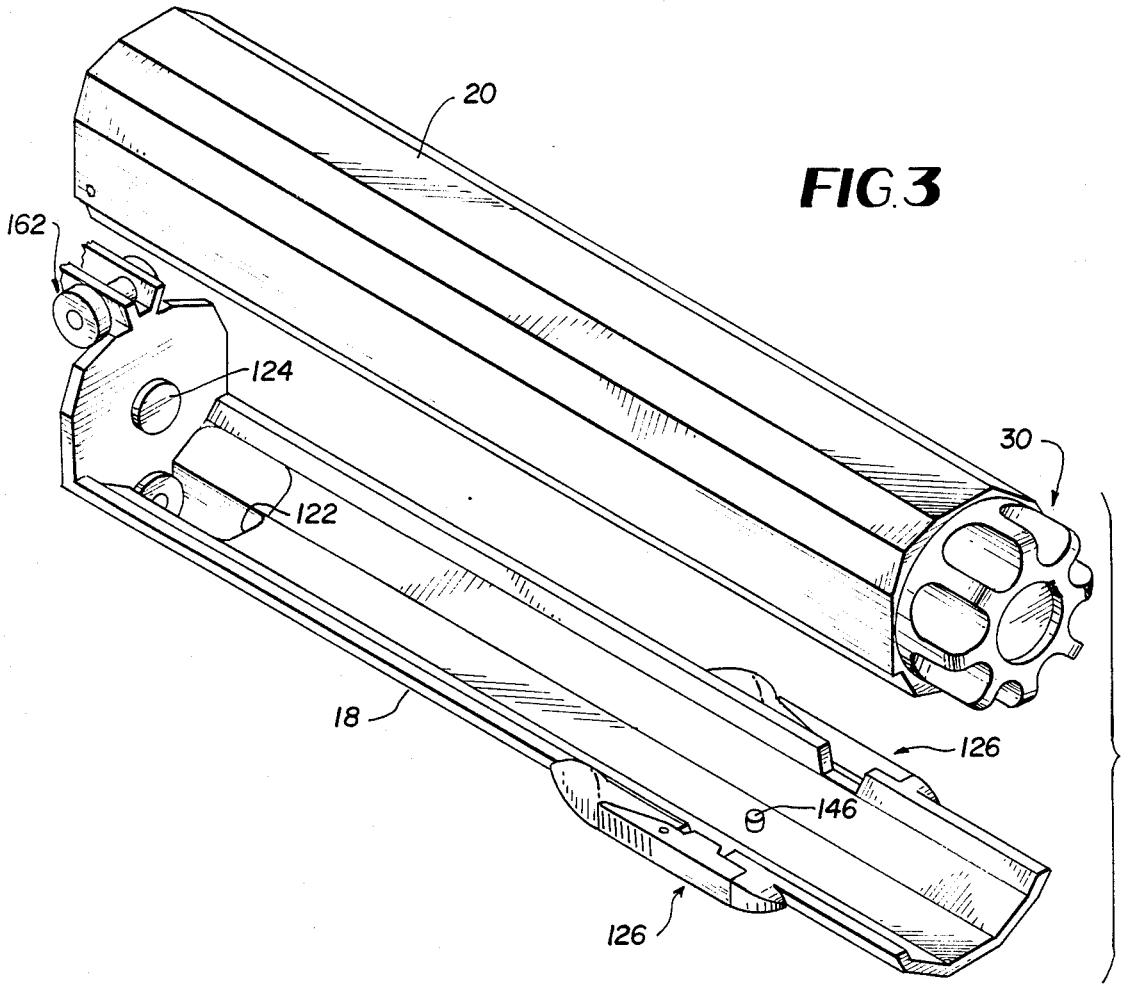
FIG. 3 is an exploded perspective view showing the mounting of the magazine of FIG. 1 onto the gun.

Referring to FIGS. 5 and 10 and also to FIGS. 3 and 4, the clutch/winder 30 is shown in detail. Overall, this part of the magazine can be thought of as a silent operating, centrifugal action, ramp-type clutch. This part of the magazine comprises a winding knob 52, a release button 54, a release button return spring 56, a clutch race member 58, and the previously described front dog member 48. Front and rear snap rings 60 are used to hold the parts of the clutch assembly 30 together. Some of these parts are omitted in the showing of FIG. 10 because of its smaller size and so as not to clutter the drawing.

The clutch knob assembly 52 is formed with a circular shoulder portion 62 which is formed with three equally radially spaced clutch member grooves or ramps 64. Each groove receives a clutch member 66 which in the embodiment shown is in the form of a small cylinder. The shoulder portion 62 fits snugly within a recess on the inside (not shown) of the race member 58.

These parts, 58, 62, 64 and 66, are so configured that when the knob 52 is turned in the winding direction, the ramps or slope built into the groove 64 is such as to cause the member 66 to roll down into the groove 64, radially inwardly. This permits a free motion of the shoulder 62 on the inside of the race 58. However, as soon as that winding force is released, the energy stored in the torsion spring 38 will impart a vigorous counter rotation force to the knob member 52, which will, by centrifugal force, throw the clutch members 66 radially outwardly, where they will wedge between the ramps 64 and the inside of the race member 58.

Advantageously, all of the parts of the magazine and of the clutch assembly, except for the members 66 and the springs, screws, snap rings and other hardware which are all made of metal, are made of durable plastics such as a fiber-filled nylon known as "Minlon" sold by DuPont. This particular plastic not only wears well, but lends itself to molding, thus even further facilitating manufacture and enhancing the invention's economic advantages.

Concentrically with the shoulder portion 62, the knob member 52 is formed with a rear end dog portion 68.

The release button 54 is formed with an enlarged rear portion 70, and a front reduced diameter portion 72, these two portions being separated by an annular shoulder 74.

An important advantage of the invention is that the magazine can be loaded with bullets in the factory or at a time other than during combat or hunting when it may be required for use with substantial urgency. The fatigue problem of the main drive spring 38 is avoided due to the release provided by this clutch/winder assembly 30. Further, releasing the spring tension after the magazine is wound up for use, as when not all of the bullets have been expended from the magazine, is another advantage, again permitting the magazine to be stored either full or partially full with the spring released.

Another advantage in this regard is that since the magazine is made virtually entirely of plastic, the motion of the parts is silent. That is, winding up of the spring to prepare the magazine for use can be done in a combat or hunting situation and the enemy or the game will not hear any noise due to the silent operation of the clutch/winder 30.

In order to release the spring tension, the user simply presses on the rear end of the button 54. This causes the shoulder 74 to bear against the front dog 46, and to push it frontwardly until the dog teeth on the two members 48 and 68 are out of engagement. When that occurs, the torsion spring 38 is no longer restrained at its rear end, and the rear dog member 48 can spin freely on the front portion 72 of the release button 54 until the spring is fully relaxed. At this same time, the dogs 50 on the front anchor 42 may slide freely in the grooves 51 formed on the inside front end of the drive member 36. When the spring is next wound, the first quarter rotation of the knob 52 will cause the dog teeth in the parts 48 and 68 to "find" each other under the urging of the spring 56 which will be urging the front dog member rearwardly and into engagement. After this first quarter turn, at the most, the dog teeth will be reengaged and winding of the spring 38 will proceed. The opening in the race member is sufficient to easily slidingly receive the dog portions 48 and 68 and to permit the motion of the front dog portion 48.

Figure 2:
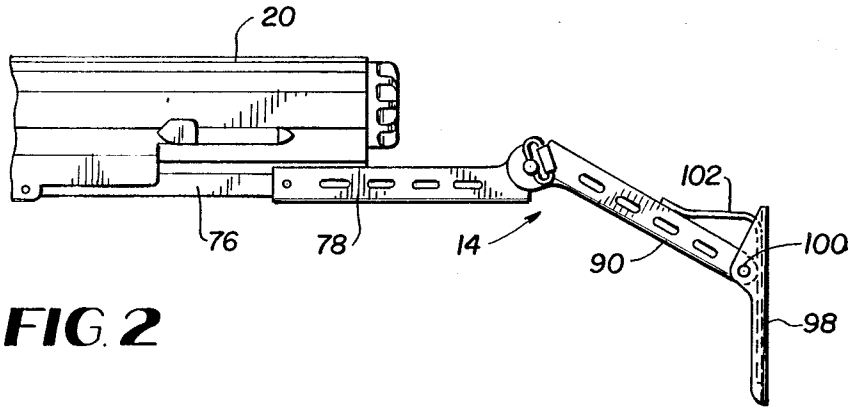
FIG. 2 is a partial side elevational view similar to the rear (right side) end of the gun in FIG. 1 showing the butt stock extended.

The folding butt stock of the invention gun/magazine is shown in FIG. 1 in the folded or stowed condition and in FIG. 2 in the extended for use position. The arrows in FIG. 1 indicate the motion of the parts in moving from the stowed or folded position to the unfolded use position of FIG. 2.

Figure 14:
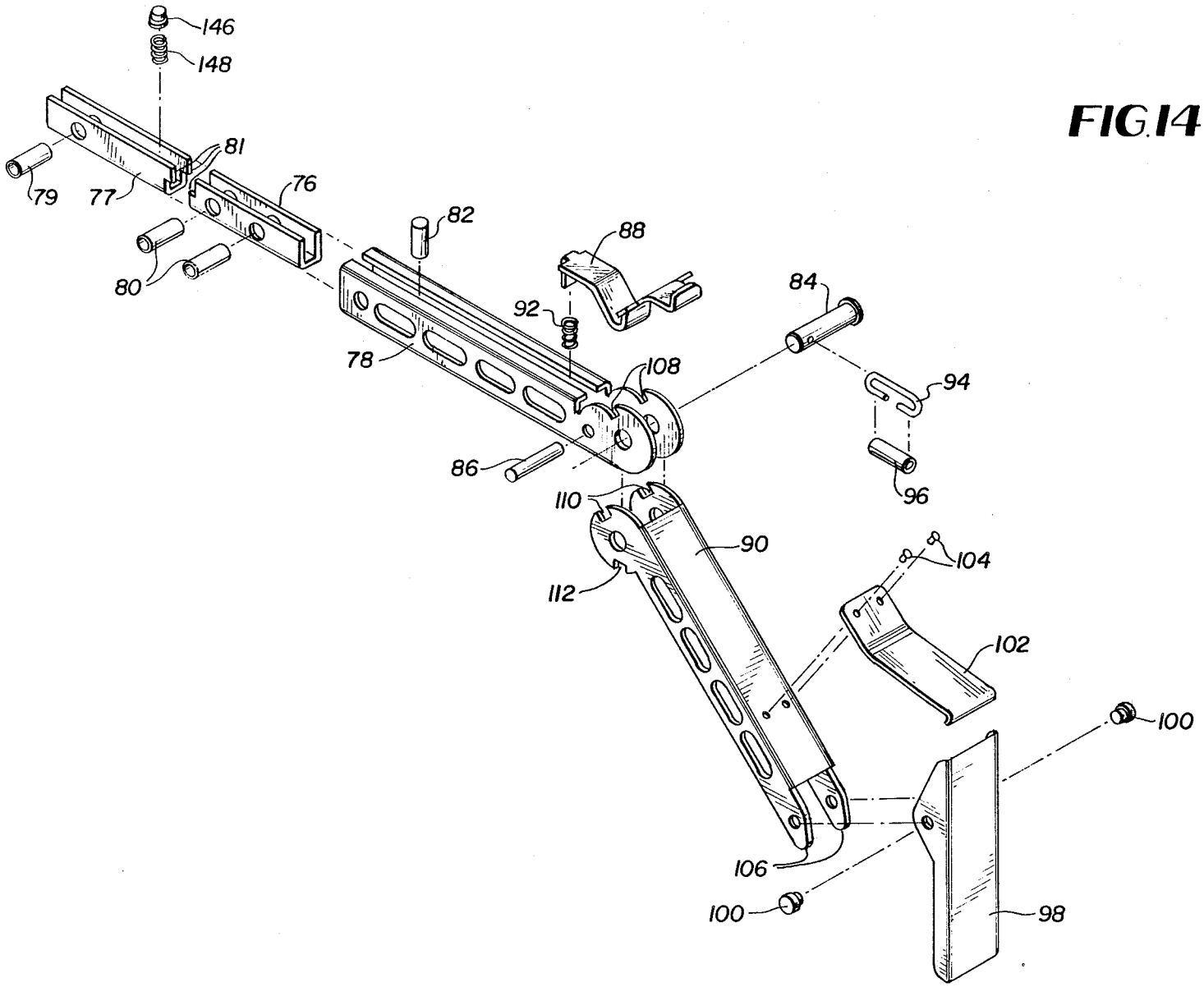
FIG. 14 is an exploded view of the folding butt stock of the invention.

The butt stock is mounted to the gun by a fixed track member 76, FIGS. 2 and 14, by means of a plurality of roll pins or the like 80. A sliding arm 78 is nested on fixed track member 76. A pin 82 fixed to the gun, see also FIG. 10, is provided between the parts 76 and 78 to limit the extension of the butt stock between the two positions shown in FIGS. 1 and 2. Pin 82 rides in a slot in the cross over segment of arm 78, see FIG. 10.

Means are provided to hold the sliding track 78 in the extended position in a positive manner. To this end, a pivot trigger or lock 77 is provided. Trigger 77 is pivoted to the gun on a pin 79. The fixed track is held in place by the pins 80 previously described. The facing ends of the members 76 and 77 are formed with tabs 81 which when they are resting on each other when the members 76 and 77 are in line with each other permit the moving track 78 to slide over the full length of the two tracks 76 and 77. However, when the moving track 78 is extended, the spring 148, which also biases the magazine ejection pin 146, biases the trigger 77 downwardly to thereby prevent the track 78 from retracting on to the fixed track 76. In order to fully collapse the moving track 78, it is necessary to lift trigger 77 so that it is in alignment with the fixed track 76 to thereby permit the sliding track 78 to retract fully, i.e., to move all the way to the left as shown in FIG. 14.

In this manner, the spring 148 is caused to perform two functions, that is, to eject the magazines and to hold the butt stock extended. This achieves additional economies of manufacture and cost of parts, another advantage of the present invention.

Another important advantage of the folding butt stock 14 is that it folds to a very compact configuration, see FIGS. 1 and 10. In FIG. 22, it can be seen that all three of the members 76, 77 and 90 nest on one another in the folded, collapsed or stowed position of the butt stock. This causes these parts to take the minimal possible space to thereby facilitate use of the invention in different postures, as shown in the succeeding Figures.

At its rear end, the sliding track 78 is provided with an enlarged portion which receives a pivot pin 84 as well as a release lever rocking pin 86. The butt stock pivoting arm 90 is mounted to the member 78 by the pin 84, and the release lever 88 is mounted thereto on the rocking pin 86 and is held in operative position by a compression spring 92. These parts are shown in greater detail in FIGS. 17 and 18 as well.

An open obround ring member 94 is provided to fit into a suitably formed opening at the outer end of the pivot pin 84 to lock it in place between the members 78 and 90. The open end of this ring is closed by a sleeve 96. The parts 94 and 96 serve as a point to which to attach a strap, or in any event at the least provide a more military appearance to this part of the butt stock.

The butt stock 14 includes a swiveling butt plate 98 which is held on the outer end of the pivot arm 90 by means of a pair of hinge pins 100. A flat spring 102, secured in place intermediate the ends of the cross face of the pivot arm 90 by rivets 104, is provided to have its free end bear against the butt plate 98, see also FIG. 2.

The rear end of the pivot arm 90 is cut away as shown in FIG. 14 to include a pair of tapered surfaces 106. As can be seen in FIGS. 1 and 14, this combination of features provides a butt plate which when extended as shown in FIG. 2 is rigid as to pivoting in a clockwise manner about its pivot 100 due to the interaction of the surfaces 106 with the inside of the butt plate 98 below the pivot point. When folded, the spring 102 is tensioned, and thus holds the parts of the folding butt stock securely in place in the position shown in FIG. 1.

Means are provided to positively lock the folding butt stock in both the folded position of FIG. 1 and the extended position of FIG. 2. Referring to FIGS. 14, 17 and 18, the enlarged end of the sliding track 78 is formed with a pair of slots 108. The enlarged mating end of the pivot arm 90 is formed with two pairs of slots 110 and 112, both of which are similar in configuration to the slots 108. The release lever 88 is formed with a central bight portion 174 which is fitted about the release lever rocking pin 86 as shown in FIG. 17. To one side of this pivot, the lever 88 is formed with a pair of arms 116 having a configuration similar to the slots 108, 110 and 112. The end of this lever arm of the member 88 is formed with an operating finger 118. To the other side of the bight 114, lever 88 is formed with a turned over portion 120 which contains the spring 92 which normally biases the lever 88 to the right or clockwise as shown in FIG. 17.

In use, the fingers 116, in the folded position of FIG. 1, mate positively with the mating slots 108 and 112. In the extended position as shown in FIG. 2 and FIG. 14, these fingers 116 fit in to the mating slots 108 and 110. In this manner, a positive lock in both the extended and the stowed position of the butt stock is provided.

Means are provided to permit quick mounting and dismounting of magazines 20 onto the gun of the invention. Referring to FIG. 3, the rear body 18 of the gun is formed with a receiver opening 122 through which the cartridges exiting the magazine through the feed lips 32 enter the gun for firing, see FIG. 10 in this regard. Thus, the gun of the invention is what is known in the art as top loading, that is, the bullets enter the gun vertically downwardly from the magazine. The magazine is also positioned in line with the axis of the gun and directly thereabove. This provides important advantages as discussed above and also below in regard to FIGS. 19, 20 and 21.

One form of means to removably hold the magazines in place in shown in FIG. 3. This comprises a boss member 124 formed in a vertical wall defining the front end of the magazine receiving portion of the rear body 18 of the gun. The front end of the magazine 28, see FIG. 10, is formed with a mating opening to receive this boss 124. This serves as a locator so that the magazine is correctly aligned axially into its desired position on the gun in receiver 18. The magazine 20 is also properly located on the gun by mating rails and ledges therebetween running the whole length of the magazine, see FIG. 3.

Latch means are provided to releasably secure the magazine in place. The preferred embodiment of these latch means is shown in FIGS. 3 and 9, and details and variations thereof are shown in FIGS. 22 through 26.

The rear body 18 is formed with a pivot block 128 adjacent to a cut-out 130 in which a latch member 132 formed on the magazine 20 is received. A latch member 134 is mounted by means of a pin 136 on the block 128. A spring 138 urges the latch 134 to the normally latched position with the latch finger 140 engaged in the opening in the magazine latch member 132. To either side of the vicinity where the latch 134 is secured, the receiver 118 is formed with fairing or mating portions 142 and 144 to the front and the rear of the latch 134, respectively, these portions serving to smoothly blend the latch into the side of the rear body of the gun 18 and to prevent inadvertent operation of the latch as by its ends catching on clothing or passing objects, or as a result of the gun being dropped, or the like. Of course, a similar structure to the latch assembly 126 shown in FIG. 9 will be provided on the opposite side of the gun.

The portion 132 of the magazine itself fits into the slot 130 to further help in locating the magazine properly on the gun for use. Operation of the latches 134 by pressing on the front ends thereof, shown with the finger serrations, releases the finger 140 from the mating opening in member 132 on the magazine.

Means are also provided to positively urge the magazine once released off of the gun and directly into the hand of the user. This is an important advantage of the invention in that it speeds changing the magazine, and permits changing magazines in the dark or without looking at the magazine, all of which can be critical especially in military applications.

To this end, referring to FIGS. 3 and 10, a spring loaded magazine ejector pin 146 has its upper free end passing through to the magazine receiving portion of the rear body of the gun 18, and bears against the underside of the magazine when it is latched in place on the gun. The spring 148 is a compression spring and is trapped between the enlarged inner end of the pin 146 and the trigger 77 of the folding butt stock, see the right-hand side of FIG. 10. and FIG. 14.

Thus, in operation, when the latches 134 are released, the magazine will literally spring up into the users's hand, and his hand will be ready to receive it because he will have used his thumb and forefinger of that hand to simultaneously operate both latches 134. Only when both latches 134 are operated will the gun release the magazine, and at that time it will literally spring up into his hand for ready removal. The pin 146 is automatically retensioned when a new magazine is latched down in place on the rear body 18.

Figure 11:
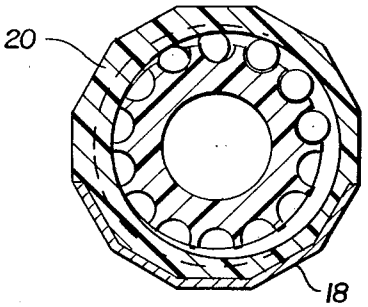
FIG. 11 is a cross-sectional view taken on line 11—11 of FIG. 10.

The magazine 20 itself has numerous other advantageous features and variations. One of these has to do with remounting of the magazine onto the gun. It is of course important that the magazine be correctly oriented with the feed lip 32 in its proper position over the cartridge receiving opening in the gun. To this end, the first embodiment of the magazine shown in FIG. 1, see also FIG. 11, is formed with prismatic shaped outer casing. Further, the radius, as it were, of these prismatic surfaces is larger at the upper end of the magazine which is exposed than at the lower end which is received in the gun 18. This, as shown in FIG. 11, gives one indication to the user while holding a magazine in his hand which he is preparing to put into position on the gun that it is correctly oriented to be mounted on the gun.

Figure 12:
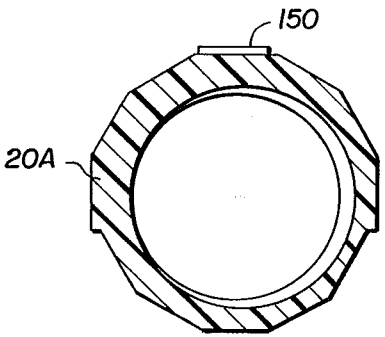

The magazine 20A of FIG. 12 shows a variation thereof wherein a member 150 molded into the magazine is provided at the top surface thereof. The user, when positioning the magazine on the gun, has an indication that the magazine is correctly positioned for mounting, or more accurately has an additional indication of correct orientation, when the part of the magazine 150 is vertically upwardly.

Figure 13:
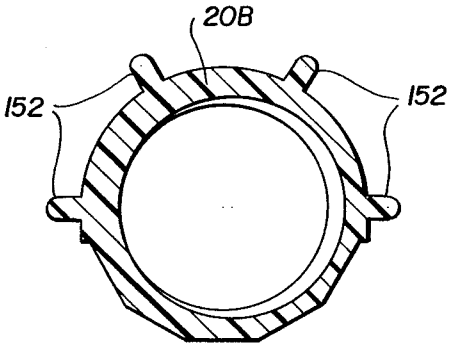
FIGS. 12 and 13 are views similar to FIG. 11, with the center drive member omitted, showing two different variations of a feature of the invention.

Yet another variation is shown in FIG. 13, the magazine 20B having a plurality of extending fingers 152 protruding outwardly in a recognizable pattern on the upper side of the magazine. Here again, the user knows that the magazine is correctly positioned when the protrusions 152 are correctly oriented. Other variations of such tactile means to position the magazine, as in combat or in the dark, by feel rather than by sight, may be provided and will present themselves to those skilled in these arts.

Another feature of the magazine has to do with the screw thread 34 used to drive the bullets in a spiral path through the magazine into the gun. This feature is shown in detail in FIG. 8 and also in FIGS. 4 and 10. In FIG. 8 is indicated an angle D which is provided on each side of the screw thread 34. Attention is also directed in this regard to FIG. 4, wherein it can be seen that the flutes 154 in the drive member 36 have an angle that is curved around the axis of the drive member 36. The appearance in longitudinal cross-section of this curvature of the flutes is illustrated in FIG. 10. Likewise, the angles assumed by the cartridges as they are fed is also illustrated at the left end of FIG. 10.

The embodiment of the invention illustrated in FIGS. 4 and 10 is for .22 caliber cartridges having rims. These are the conventional, currently popular .22 caliber cartridges. Where a different size and/or type of cartridge is to be handled, then the sizes and shapes of the parts will be adjusted accordingly. For example, for thicker cartridges, the number of flutes 154 may be decreased and their depth increased, and the magazine might be of a larger overall diameter. For longer or shorter cartridges, the adjustments will include corresponding changes in the pitch of the helical thread 34.

Because of the rim on the cartridges, there is in effect a substantial taper of the cartridge overall from the rear end toward the front end. However, even in so-called rimless cartridges, a slight taper is still provided to the casing from the rear to the front. The reason for this is that absent this slight enlargement at the rear, it would be virtually impossible to feed and eject the cartridges and then to eject the spent shell.

In this regard, the present invention is not concerned with ejection of spent shells. It may be downwardly or to the side or in any other direction. As far as the invention is concerned it is important that the gun be top loading vertically downwardly with the magazine arranged above the gun and axially in line with the gun.

Returning now to FIG. 4, the curved flutes are desirable for proper operation of the invention gun/magazine system. The current cartridge in the feed lip 32 about to be fed into the receiver 122 of the gun has to have its nose pointing out, that is, down into the gun. The curvature permits the nose of the next following cartridge to push the cartridge in the feed lip into that posture so that it will feed properly, i.e., to push the cartridge to be next fed into the gun to be nose down and out.

It is believed that with straight flutes and without some means to cooperate therewith to cause this canting of the cartridges, the magazine simply would not feed cartridges into the gun. However, a variation with straight flutes in accordance with the invention is shown in FIGS. 6 and 7 and is described below.

The sloping walls of the screw thread 34 are defined by the angle D, see FIG. 8. This angle D can be different on each side of the thread 34. One side of the thread is active together with the flutes in loading cartridges into the magazine, and the opposite side is active when feeding the cartridges out of the magazine into the gun. Depending upon the various considerations, angle D can vary between 0 and 45 degrees. For .22 caliber rimmed cartridges this angle has been found to be preferably approximately 32 degrees, and it has been found desirable to make the angle equal on both sides of the thread. It is thought that, depending upon the particular manufacturing method used, at least some slight angle for angle D should be provided in order to facilitate manufacture.

FIGS. 6 and 7 show another variation of the drive system of the invention. FIG. 7 shows straight flutes 154A, as opposed to the curved flutes 154 of FIG. 6 and the other Figures. However, in order to get the proper feeding of the cartridges as discussed above, a star wheel 160 which continues the flutes 154A, but which has the curvature of the flutes 154 of FIG. 6, is provided. In this manner, a straight fluted drive member 36A can be used in the invention system.

The star wheel 160 can also be used in conjunction with the FIG. 6 version if it should be desired to provide added protection against wear at the front end of the flutes. That is, in FIG. 6, the star wheel 160 will continue smoothly from the curvature of the flutes 154, but will provide a metal member at this junction, that is, that point at which the cartridges are fed out of the magazine and into the gun, or into the magazine to load the magazine. This is another facet of the versatility of the invention.

Figure 15:
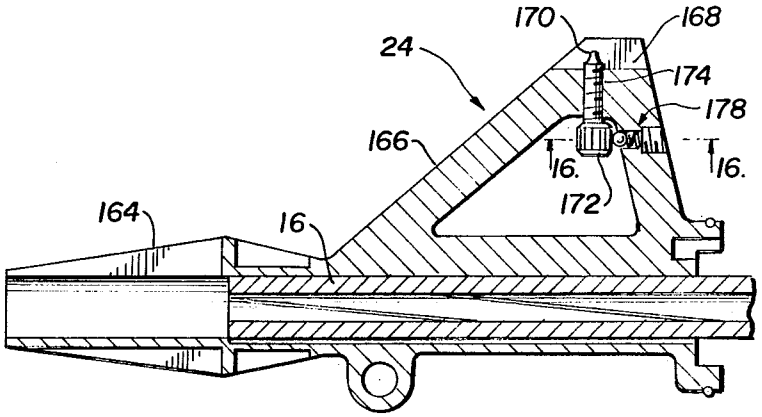
FIG. 15 is a partial vertical elevational view partly in cross-section of the front signal of the invention gun.
Figure 16:
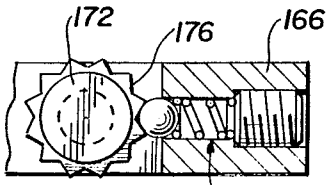
FIG. 16 is a cross-sectional view taken on line 16—16 of FIG. 15.

Referring now to FIGS. 15 and 16, the front sight 24 is shown in detail. The rear sight 162 shown in FIG. 1 is more or less conventional, except that it is raised up above the magazine 20, and thus the rear sight 162 is not described in any further detail.

The front sight 24 includes a flash suppressor 164 which runs smoothly into the front sight front arm 166 and which terminates at a pair of fingers 168. An elevation adjusting pin 170 is provided between the fingers 168. A knob 172 operating through threads 174 and a detent 176 are provided to adjust the height of the pin 174 for elevation and aiming purposes. A ball 178 is provided to cooperate with the detents 176.

The parts are configured so that each click stop of the detent 176 with respect to the ball 178 is equal to a predetermined change in elevation of the gun with respect to the target at a specific distance from the gun.

The front sight has the additional advantage of permitting operation of the knob 172 in the field with only the fingers of the user and not requiring any tools for that purpose.

FIG. 22 also shows the nested character of the parts of the butt stock 14.

FIGS. 23, 24, 25 and 26 show further variations of the means to secure the respective magazines 20C, 20D, 20E and 20F to the gun in different embodiments.

In FIG. 23, the magazine is formed with a pair of simple tits formed on the sides thereof which cooperate with spring clips 182 fixed to the gun receiver 18C. This version is perhaps the least expensive to build, and might be suitable for target shooting, sport use, and the like. The cooperating tits 180 and spring fingers 182 permit very simple snapping in and out of this magazine 20C. Other locating means such as are described elsewhere herein can be used in conjunction with the parts 180 and 182 as needed.

Referring to FIG. 25, the embodiment 25D includes a pair of integral fingers 184 which cooperate with toggle-type latches 186 to hold the magazine in place. The embodiment 20D is otherwise similar to the embodiment 20C.

FIG. 24 shows another embodiment 20E which comprises a pair of locator fingers 188 formed on the magazine 20E. Cut-outs 190 are formed in a lower cover member 196 secured to the gun. A top cover member 198 is hinged to the gun at 200 to cooperate with the member 196. A toggle-type latch 192/194 is provided to securely hold the magazine 20E in place. This embodiment 20E might find use in a particularly harsh environment, perhaps in military environments wherein the magazine 20E can simply be put inside the unlatched covers 196/198 and properly located therein by the fingers 188 in the cut-outs 190, and then latched in place by the parts 192 and 194. This has the advantage of completely insulating and securing the magazine 20E from the environment outside the gun.

Magazine 20F of FIG. 26 is held in place by a bail member 202 which is hinged to the weapon at 204. Securing means such as latches, asymmetrical cross-sectional shapes, internal ridges and ledges between the bail and the magazine, all are possible in this FIG. 26 version of the securing means.

Thus, it can be seen that the invention has great versatility as to this aspect of the magazine securing sub-system thereof, namely, many variations and types of ways of removably securing the magazine to the weapon could be provided. For example, the FIG. 23 version might be useful in a low-priced weapon for sport or target-shooting purposes. The other versions may find utility in other specific applications, all of which are well known to those skilled in these arts.

OPERATION

FIGS. 19, 20 and 21 show various ways in which the gun/magazine of the invention can be used.

FIG. 19 shows the butt stock extended and the weapon being used as a rifle in a conventional manner.

FIGS. 20 and 21 show the same weapon with the butt stock folded. In FIG. 20, the weapon is being used like a pistol, that is, held in one hand with the arm extended fully outwardly. It should be noted that, with the butt stock collapsed, it is entirely out of the user's way, thus permitting this pistol-type posture.

FIG. 21 illustrates the fact that, because of the compact nature of the invention, with the butt stock folded, the weapon can be held at the hip and in the crook of the arm, which facilitates the so-called military "point-shoot" posture. While FIG. 21 shown the user holding the weapon in both hands, this user could as well have his left hand free for other purposes, holding the weapon on his right forearm and in his right hand. In this manner, he can pivot and shoot without turning his body, by simply pivoting his arm from the shoulder. Since the invention gun/magazine system is symmetrical about a vertical plane through the line of fire, it is just as well adapted to left-handed users.

Another facet of the operation of the invention is that because of its extremely small size, which is due to the compact magazine, the in-line arrangement of the magazine, and the folding butt stock, a semi-automatic or carbine weapon could be concealed in the clothing of security guards, secret service men, and the like. This is an enormous advantage for such applications wherein an automatic or semi-automatic weapon with a large ammunition capacity can be concealed on the person.

The "point-shoot" posture requires that the weapon be a continuation of the line of the forearm of the user, and this is clearly the case with the invention system as is shown in FIG. 21.

The invention gun/magazine system when used in the military environment has a unique advantage. Currently, the logistics of military usage are in effect doubled. Soldiers in the field must deal with boxes of loose cartridges and boxes of empty magazines, and must load their own magazines in the field. This is so because it is not practical or viable to ship loaded, large-capacity clips of cartridges because the spring, which would be fully compressed once the clip is loaded at the factory, will lose some of its drive ability due to fatigue. For this reason, there is no alternative for military applications but to ship cartridges loose and magazines emtpy.

With the present invention, the magazine can be fully loaded with cartridges, but the spring left in a relaxed state. The soldier in the field is relieved of the tedious and time-consuming and perhaps dangerous waste of time needed to load clips during combat. He simply winds up the spring when he snaps the magazine onto his gun. This takes no more than a few seconds, and in fact the soldier can wind up his magazines before going in to combat. That is, those he will carry on his person can be fully wound and ready for immediate use that day.

Yet another advantage flowing from this facet of the invention is that battlefields are often very dirty, harsh environments for delicate mechanisms. The possibility of the cartridges and the magazines becoming coated with grime and dirt and the like is another danger for the soldier. That is, the danger of his weapon jamming or misfiring is diminished because he has clean, fully loaded magazines to use, and there is no possibility of exposure of the cartridges to the dirty, harsh environment in a manner that could harm the operation of the gun/magazine system.

Thus, on an overall basis, the logistics of supplying ammunition to soldiers in the field is literally cut in half. Instead of having two types of things to inventory, that is, loose cartridges and empty magazines, the quartermaster personnel need deal only with full magazines ready for use upon winding of the spring. This is an enormous advantage for the invention and a very substantial step forward in this art in general.

Further in this regard, the invention magazine can hold on the order of one hundred 9 mm. military cartridges compared with thirty or thirty-two such cartridges for conventional high-capacity magazines presently in use. Thus, the logistics are not only cut in half due to the elimination of separate shipment of empty clips and cartridges, but are again cut by one-third because the invention magazine has over three times the capacity of present high-capacity ammunition clips. Thus, the logistics are reduced not merely by a factor of three due to the large capacity of the magazine, and not only by a factor of two due to the cartridges and clips being shipped together, but by a factor of six, since these advantages multiply with each other.

Yet a further advantage of the invention in use has to do with the fact that except for the drive spring and the screws and small hardware, the magazine is made entirely of plastic. If because of this, magazine cost can be reduced sufficiently, then another military highly desired feature of a magazine which is simply discarded after use may possibly be achievable in accordance with the teachings of the invention gun/magazine system.

The invention provides an extremely light weight, compact weapon system having greatly improved handling. As compared to other automatic or semi-automatic weapons using conventional clips, such as a so-called banana clip or a drum magazine, in the present invention the entire mass of the magazine, even with the unprecedented large number of cartridges, is very close to the line of recoil due to the fact that the magazine is elongated and arranged axially with respect to the axis of the gun. Thus, the moment arm of the magazine with respect to the gun axis, which is the line of recoil, is very short, perhaps an inch or two inches. With banana clips or drum magazines, this moment arm can be on the order of four or five or more inches, thus causing a greater tendency to push the gun off of the aiming axis in response to the recoil of the weapon.

The invention thus provides a top loading gun, having a spiral drive magazine, which is arranged above the gun and axially in line therewith. Other features include the unique folding butt stock, the modified front sight to permit easy viewing and aiming over the top of the magazine, as well as numerous features in the magazine itself.

The silent clutch/winder built into the magazine provides numerous advantages and facilitates operation. In a military, hunting, target shooting, or whatever environment, when only some of the cartridges in the magazine are used, the spring can be relaxed simply by pushing the release button. This immediately imparts to the partly loaded magazine an indefinite shelf life due to the lack of any possibility whatsoever of fatigue of the drive spring. The silent clutch permits use in sensitive environments such as military or hunting, to prepare the weapon for use even when it is necessary to change to a fresh unwound magazine.

The flutes on the drive member inside the magazine serve an important function of insulating the cartridges from the full strength of the drive spring. That is, with a large number of cartridges on the order of one hundred or so, and with the strength of the spring needed to drive all one hundred cartridges, absent these flutes the pressure on the one-hundredth cartridge could cause crushing or damage to the first cartridge, if each individual cartridge were not insulated from that full force by the flutes.

Further, the flutes together with the internal spiral member, the pitch of which and the configuration of the thread of which is designed for a particular cartridge, cooperate to drive each cartridge through the magazine and to drive each cartridge in effect individually. That is, each cartridge is effectually "encased" in a separate system of forces made up of the two sides of the flute and the two ends of the turns of the thread in which it then is located as it progresses through the magazine. This is the "insulation" of each cartridge from the full spring force to which this discussion refers.

The fabrication of the magazine virtually entirely from plastic improves operation in that the weight of the increased number of cartridges is counterbalanced by the reduction in weight of the magazine itself. Further, plastic fabrication yields additional advantages of simpler manufacturing and lower cost, as well as reduced weight.

While the gun is top loading, the strong drive spring which positively ejects each cartridge from the magazine and urges it into the gun, assures proper operation in all postures. That is, at the extreme, the invention gun/magazine system can even be used upside down, and it will function perfectly. Put another way, the invention system is immune from gravity.

The invention permits mounting the magazine on the gun in many different manners to accommodate the requirements of all sorts of different environments and fields of use. These systems include arrangements of and combinations of latches, covers, a bail, and a system of mating a pin and recess at the front end together with nesting rails and ledges and side latches. This latter is the preferred embodiment.

The invention system can be used together with all sorts of firearms, machine guns, semi-automatic rifles, automatic pistols, machine shotguns, and the like, with only relatively simple mechanical modifications and no conceptual modifications to such weapons to accommodate the high-capacity magazine of the invention and all of its other advantages, including improved handling.

The invention thus produces an extremely compact gun/magazine, this system having no projections transverse to the gun's axis, and with an unprecedented large capacity of cartridges in the magazine. Thus, the invention provides a gun/magazine system having improved weight distribution, and correspondingly dramatic improved handling characteristics in addition to numerous other detailed advantages as set forth herein.

While the invention has been described in detail herein, it is to be understood that this detailed description is by way of example only, and the protection granted is to be limited only within the spirit of the invention and the scope of the following claims.

We claim:

1. A gun/magazine system comprising a top loading gun, an ammunition magazine, means to removably mount said magazine on said gun above and closely spaced to the axial line of fire of said gun, said gun comprising grip means and barrel means defining said line of fire and extending forwardly of said grip means, said gun including a trigger means, said grip means and said trigger means being so located on said gun that said grip means can be gripped and simultaneously said trigger means can be operated with one hand of a user, said magazine mounting means locating said magazine on said gun at least substantially rearwardly of said grip means, whereby the front/rear balance and handling of said gun/magazine system is enhanced, said magazine including a drive spring to urge the ammunition stored in the magazine into said top loading gun, said magazine including winder means for said drive spring and manual release means to relieve the energy stored in said drive spring regardless of the amount of ammunition in said magazine, and means for operating said winder means and said manual release means independently of the loading and unloading of ammunition into and out of said magazine.

2. The system of claim 1, said gun/magazine including a front sight means extending up from the front of said gun so that said front sight can be viewed over the top of said magazine, said front sight means including aiming means comprising a pin, said sight also including aiming elevation adjusting means and means to operate said aiming elevation adjusting means manually without the use of any tool, said means to operate comprising a manual operating knob depending from said pin and formed with detent means, and said detent means serving as both manual gripping means and as part of said aiming elevation adjusting means.

3. The system of claim 1, said means to removably mount said magazine on said gun comprising manually operated securing means and magazine ejector spring means between said gun and said magazine so arranged that said magazine ejector spring means are loaded with energy when a magazine is secured in place on said gun and so arranged to move said magazine away from said gun upon release of said securing means.

4. The system of claim 1, and said grip means comprising a pistol-type grip mounted on said gun/magazine generally intermediate the total length thereof.

5. The system of claim 4, and a folding butt stock mounted on said gun/magazine rearwardly of said pistol grip and below said magazine.

6. The system of claim 1, said magazine being of a generally cylindrical configuration, said drive spring urging the ammunition through said magazine in a spiral path around the axis of said magazine, and said magazine being removably mounted on said gun with its axis above, in line with and closely spaced to the axial line of fire of said gun.

7. The system of claim 6, said means to removably mount said magazine on said gun comprising bosses formed on the opposite longitudinal sides of said magazine and a pair of spring latch members fixed to said gun and cooperable with said bosses, said latches being so arranged on said gun and said magazine that both of said latches must be operated simultaneously to release said magazine from said gun.

8. The system of claim 6, said means to removably mount said magazine on said gun comprising fingers formed on the opposite longitudinal sides of said magazine and a pair of toggle type latches mounted on said gun and cooperable with said fingers, said latches being so arranged on said gun and said magazine that both of said latches must be operated simultaneously to release said magazine from said gun.

9. The system of claim 6, said means to removably mount said magazine on said gun comprising a two-part housing mounted on said gun and adapted to completely enclose said magazine, locator means between said housing and said magazine, and latch means to secure said housing shut with said magazine correctly located therein by said locator means.

10. The system of claim 6, said means to removably mount said magazine on said gun comprising a bail member swingably mounted on said gun and adapted to removably secure said magazine to said gun.

11. The system of claim 6, said means to removably mount said magazine on said gun comprising an interfitting boss and recess at one longitudinal end of said magazine where said magazine end is received on said gun, mating ledges and ridges between said gun and said magazine extending longitudinally of said magazine, and manually operable latch means to removably secure said magazine on said gun.

12. The system of claim 4, said latch means comprising a pair of elongated latches mounted on said gun extending longitudinally with respect to the gun's axial line of fire and positioned one to either side of said magazine, said latches being so arranged on said gun and said magazine that both of said latches must be operated simultaneously to release said magazine from said gun, and fairing means at either end of each of said latches for preventing inadvertent operation of said latch means.

13. The system of claim 12, and magazine ejector spring means between said gun and said magazine so arranged that said magazine ejector spring means are loaded with energy when a magazine is latched in place on said gun, whereby a user can reach across a latched magazine on said gun using the fingers on one hand to operate both of said latches simultaneously and whereby upon unlatching of said magazine said ejector spring means causes said unlatched magazine to move into said one hand used to unlatch said latch means.

14. The system of claim 1, and tactile means to assist in mounting said magazine on said gun, said tactile means comprising a plurality of longitudinal surfaces formed on the outside of said magazine and extending over at least a substantial portion of the length of said magazine.

15. The system of claim 1, and tactile means to assist in mounting said magazine on said gun, said tactile means comprising an asymmetrical cross-sectional shape of said magazine.

16. The system of claim 1, and tactile means to assist in mounting said magazine on said gun, said tactile means comprising a plurality of protruding portions formed on the portions of said magazine which will be the furthest away from the gun when the magazine is mounted thereon.

17. The system of claim 1, said winder means including a silent operation centrifugal action ramp-type clutch.

18. The system of claim 1, a drive member for ammunition rotatably mounted inside said magazine, said drive spring being a coiled torsion spring having a wound-up length less than the length of said drive member and having a relaxed length a predetermined amount shorter than the length of said drive member, said drive spring being located inside said drive member, means to fix one end of said drive spring to said winder means, a drive spring anchor member located inside said drive member, means to fix the other end of said drive spring to said drive spring anchor member, and means to secure said anchor member to said drive member so that said anchor member is prevented from rotating with respect to said drive member and so that said anchor member can move axially with respect to said drive member to accommodate the changes in length of said drive spring between its relaxed and wound-up conditions.

19. The system of claim 18, said means to secure said anchor member to said drive member comprising dog means extending radially outwardly of said anchor member and longitudinal groove means formed on the inside of said drive member to snugly and slidingly receive said dog means.

20. The system of claim 1, said magazine being of an elongated generally cylindrical configuration, said magazine comprising an outer housing, a drive member for ammunition cartridges rotatably mounted within said outer housing, said drive member being formed with a plurality of flutes extending at least generally axially of said drive member, said flutes being so configured as to permit a succession of said cartridges to pass therethrough in end-to-end relationship, said drive spring being strong enough to rotate said drive member within said housing even with all of said flutes filled with cartridges, said housing comprising a helical thread portion on the inside surface thereof cooperable with the cartridges in said flutes of said drive member, and feed means at the cartridge exit of said magazine to permit the cartridges therein to be fed one by one into said magazine or out of said magazine and into said gun.

21. The system of claim 20, wherein said drive member flutes are straight and parallel to the axis of said drive member, and said feed means include magazine exit end wear means, said wear means comprising a star wheel member arranged axially in line with said fluted drive member, said star wheel member being formed with flutes equal in number to and which continue from said drive member flutes but which also spiral around the axis of said drive member.

22. The system of claim 20, wherein said housing, said drive member and said winder means are all made substantially entirely of plastic materials.

23. The system of claim 20, and means to assure feeding of the last cartridge out of said magazine into a cooperating gun comprising dummy follower means, said dummy follower means comprising a pair of dummy cartridges joined together and located in said fluted drive member behind the last cartridge therein.

24. The system of claim 20, said winder means drive spring release means comprising a pair of mating clutch dog members, means to attach one end of said drive spring to one of said clutch dog members, a spring urging said dog members into engagement with each other, and a push button to operate against the force of said last mentioned spring to push said dog members out of engagement with each other to thereby permit unwinding of said drive spring, whereby a user grasping said magazine in one hand can operate said push button with a finger of said same one hand to thereby permit unwinding of said drive spring.

25. The system of claim 20, said helical thread portion having a cross-sectional shape including a pair of at least partially radially disposed surfaces each positioned at a predetermined angle to a line which is radial of said magazine, said surfaces, cooperating with said drive member and the particular size and type of cartridges being handled, and one surface adapted to facilitate loading of cartridges into said magazine and the other surface adapted to feed cartridges out of said magazine.

26. The system of claim 20, wherein said flutes spiral around the axis of said drive member.

27. The system of claim 26, and a fluted star wheel member arranged axially in line with said drive member with the flutes thereof equal in number to and continuing said drive member flutes.

28. The system of claim 1, and a folding butt stock for said gun comprising a first track member and means to fix said first track member to the gun, a second track member and means to mount said second track member on said first fixed track member to permit longitudinal sliding motion of said second track member on said first track member, a pivot arm member and means to pivotally mount one end of said pivot arm member on the free end of said second track member when said second track member is slid out and extended with respect to said first track member, a butt plate and means to pivotally mount said butt plate on the other end of said pivot arm, and manually operable lock means to positively and releasably lock said butt stock in both the extended unfolded use position and the collapsed folded stowed position.

29. The system of claim 28, said lock means comprising a locking lever, means to pivotally mount said locking lever on said second track member closely positioned to the pivotal connection between said second track member and said pivot arm, said second track member and said pivot arm being formed with a first set of notches which align with each other in said use position and a second set of notches which align with each other in said stowed position, said first and second sets of notches being located at the same position relative to said locking lever, said locking lever including a pair of fingers engageable with either said first or second set of notches, spring means at one end of said locking lever urging said fingers into engagement with said notches, and the other end of said locking levers being manually operable to disengage said fingers from said notches to permit motion of said butt stock between said use and stowed positions.

30. The butt stock of claim 28, said means to releasably lock comprising a locking trigger, said locking trigger being pivotally mounted on said gun and movable between a first position wherein it is aligned with said first track member and a second position wherein said trigger is out of line with said first track member, said second track member when extended being prevented from moving back to its collapsed position with respect to said first track member when said trigger is in its second position, and spring means normally urging said trigger into said second position.

31. The system of claim 28, and said first and second track members and said pivot arm all nesting together in said stowed position whereby said butt stock occupies a minimum amount of space.

32. The system of claim 31, and means to resiliently hold said butt plate substantially vertical in said use position, said holding means comprising a flat spring having one end secured to said pivot arm and having its other end bearing against said butt plate to urge said butt plate around its pivotal connection to said pivot arm in a first direction, said holding means further comprising stop means to limit the motion of said butt plate in said one direction, and said stop means comprising inclined surfaces formed on said other end of said pivot arm adapted to be engaged by said butt plate.

33. An ammunition magazine for a gun, said magazine comprising means to permit said magazine to be removably mounted on a cooperating gun, said magazine being of an elongated, generally cylindrical configuration, said magazine comprising an outer housing, a drive member for ammunition cartridges rotatably mounted within said outer housing, said drive member being formed with a plurality of flutes extending at least generally axially of said drive member, said flutes being so configured as to permit a succession of said cartridges to pass therethrough in end-to-end relationship, a drive spring strong enough to rotate said drive member within said housing even with all of said flutes filled with cartridges, said housing comprising a helical thread portion on the inside surface thereof cooperable with the cartridges in said flutes of said drive member; feed means at the cartridge exit of said magazine to permit the cartridges therein to be fed one by one into said magazine, or out of said magazine and into a cooperating gun; manual spring winder means for said drive spring mounted on said magazine, said winder means including manual drive spring release means for relieving the energy stored in said drive spring regardless of the number, from zero to maximum, of cartridges stored in said magazine, means for operating said winder means and said manual release means independently of the loading and unloading of ammunition into and out of said magazine, and said manual release means including a button being operable by one hand alone of a user pushing on said button to relieve the energy stored in said drive spring.

34. The magazine of claim 33, wherein said housing, said drive member and said winder means are all made substantially entirely of plastic materials.

35. The magazine of claim 33, and means to assure feeding of the last cartridge out of said magazine into a cooperating gun comprising dummy follower means, said dummy follower means comprising a pair of dummy cartridges joined together and located in an adjacent pair of flutes in said fluted drive member behind the last real cartridge therein.

36. The magazine of claim 33, said winder means including a silent operation centrifugal action ramp-type clutch.

37. The magazine of claim 33, said winder means drive spring release means comprising a pair of mating clutch dog members, means to attach one end of said drive spring to one of said clutch dog members, a spring urging said dog members into engagement with each other, and a push button to operate against the force of said last mentioned spring to push said dog members out of engagement with each other to thereby permit unwinding of said drive spring, whereby a user grasping said magazine in one hand can operate said push button with a finger of said same one hand to thereby permit unwinding of said drive spring.

38. The magazine of claim 33, said helical thread portion having a cross-sectional shape including a pair of at least partially radially disposed surfaces, each positioned at a predetermined angle to a line which is radial of said magazine, said surfaces cooperating with said drive member and the particular size and type of cartridges being handled, and one surface adapted to facilitate loading of cartridges into said magazine and the other surface adapted to feed cartridges out of said magazine.

39. The magazine of claim 38, wherein said predetermined angle for each of said surfaces is approximately 32° for .22 caliber rimmed cartridges.

40. The magazine of claim 33, said drive spring being a coiled torsion spring having a wound-up length less than the length of said drive member and having a relaxed length a predetermined amount shorter than the length of said drive member, said drive spring being located inside said drive member, means to fix one end of said drive spring to said winder means, a drive spring anchor member located inside said drive member, means to fix the other end of said drive spring to said drive spring anchor member, and means to secure said anchor member to said drive member so that said anchor member is prevented from rotating with respect to said drive member and so that said anchor member can move axially with respect to said drive member to accommodate changes in length of said drive spring between its relaxed and wound-up conditions.

41. The magazine of claim 40, said means to secure said anchor member to said drive member comprising dog means extending radially outwardly of said anchor member and longitudinal groove means formed on the inside of said drive member to snugly and slidingly receive said dogs means.

42. The magazine of claim 33, wherein said drive member flutes are straight and parallel to the axis of said drive member, and said feed means include magazine exit end wear means, said wear means comprising a star wheel member arranged axially in line with said fluted drive member, said star wheel member being formed with flutes equal in number to and which continued from said drive member flutes but which also spiral around the axis of said drive member.

43. The magazine of claim 42, wherein said drive member is made of plastic and said star wheel is made of metal.

44. The magazine of claim 33, wherein said flutes spiral around the axis of said drive member.

45. The magazine of claim 44, and a fluted star wheel member arranged axially in line with said drive member with the flutes thereof equal in number to and continuing said drive member flutes.

46. The magazine of claim 45, wherein said drive member is made of plastic and said fluted star wheel is metal.

47. A gun/magazine system comprising a top loading gun, an ammunition magazine removably mounted on said gun above the axial line of fire of said gun, a front sight mounted on said gun and extending thereabove so that it can be seen over the top of said magazine, said front sight including aiming means comprising a pin, said sight also including aiming elevation adjusting means and means to operate said adjusting means with only the fingers of a user and without any tool, said means to operate comprising a manual operating knob depending from said pin and formed with detent means, and said detent means serving as both manual gripping means and as part of said aiming elevation adjusting means.

48. The system of claim 47, said adjusting means including spring loaded detent click stop means calibrated so that each click stop corresponds to a predetermined change in elevation at a predetermined distance from said gun.

49. In a gun/magazine system, the combination comprising a gun and an ammunition magazine cooperable therewith, securing means to releasably hold said magazine on said gun, magazine ejector spring means between said gun and said magazine arranged so that said spring means are loaded with energy when a magazine is secured in place on said gun; and said securing means, said magazine and said ejector spring means being so arranged and configured that a user with one hand can release said securing means whereupon the energy stored in said ejector spring means causes the now unsecured magazine to move into that same one hand.

50. The system of claim 49, said gun comprising a top loading gun, means to removably mount said magazine on said gun above and closely spaced to the axial line of fire of said gun, said magazine including a drive spring to urge the ammunition stored in the magazine into said top loading gun, and said magazine including winder means for said drive spring and manual release means to relieve the energy stored in said drive spring regardless of the amount of ammunition in said magazine.

51. The system of claim 50, said gun/magazine including a front sight means extending up from the front of said gun so that said front sight can be viewed over the top of said magazine, said front sight means including aiming means comprising a pin, said sight also including aiming elevation adjusting means and means to operate said aiming elevation adjusting means manually without the use of any tool, said means to operate comprising a manual operating knob depending from said pin and formed with detent means, and said detent means serving as both manual gripping means and as part of said aiming elevation adjusting means.

52. The system of claim 50, a pistol type grip mounted on said gun/magazine generally intermediate the total length thereof, and said magazine extending rearwardly of said pistol grip, whereby the front/rear balance of said system is enhanced.

53. The system of claim 52, and a folding butt stock mounted on said gun/magazine rearwardly of said pistol grip and below said magazine.

* * * * *